United States Patent [19]

Wolynec et al.

[11] 4,178,647

[45] Dec. 18, 1979

[54] FOUR-WHEELED SWEEPER

[75] Inventors: John J. Wolynec, Chicago; Donald L. Hildebrand, Elgin; Victor Wasynczuk, Mount Prospect, all of Ill.

[73] Assignee: Elgin Sweeper Company, Elgin, Ill.

[21] Appl. No.: 940,598

[22] Filed: Sep. 8, 1978

[51] Int. Cl.[2] ..... E01H 1/04

[52] U.S. Cl. ..... 15/84; 298/1 C; 298/11; 298/22 P

[58] Field of Search ..... 15/83–87, 15/340; 298/1 C, 11, 22 P; 214/502

[56] References Cited

U.S. PATENT DOCUMENTS

| | | | |
|---|---|---|---|
| 2,614,279 | 10/1952 | Mott | 15/83 |
| 3,281,879 | 11/1966 | Murphy | 15/84 |
| 3,761,988 | 10/1973 | Overton | 15/83 |
| 4,071,277 | 1/1978 | Stedman | 298/22 P |

*Primary Examiner*—Edward L. Roberts

*Attorney, Agent, or Firm*—Hill, Van Santen, Steadman, Chiara & Simpson

[57] ABSTRACT

A street sweeping machine is disclosed comprising a wheeled frame, a cab is supported by the frame, a dirt receiving hopper is positioned behind the cab, a conveyor is positioned adjacent the hopper and has an upper end overlying the hopper for depositing materials picked up from a roadway into the hopper. The conveyor is pivotally mounted for movement relative to the hopper and the frame. Hopper lift means is provided for rotating the hopper off of the frame from behind the cab over the cab for unloading of the picked-up materials in the hopper at a forward end of the cab. Linkage is connected between the hopper lift means and the conveyor for pivoting the conveyor on its pivot so that its upper end moves clear from its position of overlying the hopper to allow the hopper lift means to rotate the hopper free of interference from the conveyor during the lifting movement of the hopper. Ram means is also provided for operating the hopper lift means to rotate the hopper to be unloaded forward of the cab.

20 Claims, 10 Drawing Figures

FOUR-WHEELED SWEEPER

BACKGROUND OF THE INVENTION

1. Field of the Invention

The present invention relates to a street sweeping machine.

2. Prior Art

Street sweepers that can elevate a bin full of sweepings and dump them into an open truck bed or similar container have been known for some time. Garbage or trash collection vehicles that pick up containers, either fixed to the lift arms or separable from the lift arms, and move the container over the top of the vehicle cab for dumping the container contents into the collection vehicle have been known for some time. The visibility advantage of forward positioning of an operator in a vehicle has been known for some time.

SUMMARY OF THE INVENTION

This invention describes a street sweeper which sweeps up debris from the street and stores it in a hopper-like container until the container is full. The operator of this street sweeper is located at the front of the sweeper and on the centerline of the sweeper. The operator can position the street sweeper in a dumping relationship with an operated truck (or similar collection vehicle), apply wheel brakes on the sweeper, and proceed to dump the contents of the sweeper dirt container onto a truck bed of the vehicle located in front of the parked sweeper. This sweeper may also be used for dumping sweepings onto piles off of the road or over walls or into railroad cars. According to other aspects of the disclosed invention, the street sweeper is powered by a single engine in contrast to previous street sweepers that have been commonly used so that energy savings may be attained through the use of only a single engine for powering the road traveling sweeper and for additionally providing the requisite power for operating the various systems available for use by the sweeper operator. In order to effect efficient utilization of the energy generated by the single engine, this invention also describes a new and improved hydraulic circuit.

An important object of this invention is to provide a four-wheeled street sweeper having a cab at a forward end thereof and with a dirt-receiving hopper positioned immediately behind the cab, and mechanism operable to elevate the hopper over the cab into a relatively high dump position to enable the contents of the hopper to be discharged into existing commercial trucks and railroad cars.

A further object of this invention is to provide a street sweeper of the type described in the preceeding paragraph and where the street sweeper can be positioned immediately behind a stationary receiving vehicle until the dump sequence is completed.

Still, a further object of this invention is to provide a street sweeper of the type described in the immediately preceeding two paragraphs and where the sweeper can be operated to transfer sweepings into a receiving vehicle while both vehicles occupy only a single traffic lane.

Yet, another object of this invention is to provide a street sweeper of such construction that the sweeper operator is positioned in a front-center location in a cab on the sweeper so that the operator can avoid collisions with vehicles and passengers while sweeping and also so that the operator has a clear viewing position for positioning the street sweeper with respect to a receiving vehicle or with respect to a pile, a wall, or a railroad car. Still another important object of this invention is to provide a street sweeper with counter-balancing for supporting a forward end of the sweeper as a loaded dirt box or hopper is elevated and moved forwardly over the cab into a dumping position to provide auxiliary support for the sweeper when the loaded hopper or dirt box is moved into the dumping position.

Another important feature of this invention is to provide a broom-type street sweeper where a hopper is located between its front and rear axles and where the hopper is approximately evenly loaded (weight distribution) on the axles at all conditions of hopper loading from "empty" to "full", thus providing a smooth ride for the operator during transport of the sweeper.

According to other features, the sweeper has front and rear axles that are mounted on springs to improve the smooth ride and the rear springs are provided with means that enable the springs to be locked out to improve sweeping geometry while sweeping.

Yet, another object of this invention is to provide a four-wheeled street sweeper that is a legal truck and can be operated at legal speeds up to 55 mph.

Still another important object of this invention is to provide a street sweeper which can be dumped forward of the sweeper in a single lane, thus avoiding the problems of a side-dumping vehicle where two lanes of traffic are consumed to effect dumping and where the dumping operation cannot be as easily viewed to determine correct positioning of the sweeper relative to a receiving vehicle.

The front dumping sweeper has a definite advantage over a rear dumping sweeper because in a single traffic lane dirt transfer operation, the dumping and sweeping vehicle must be tail-to-tail, thus requiring that one of the vehicles move against the legal direction of traffic flow in order to move it into a transfer position and to move it then out of the transfer position.

A sweeper having a rear elevated hopper can be dumped in an alternative position where the sweeper remains stationary while the receiving vehicle travles in a path at right angles behind the sweeper and places its receiving container in position for receiving the sweepings from the elevated hopper. If this is done at an intersection of two streets, then in most instances, two lanes of traffic would be occupied, on one of the streets unless the receiving vehicle is properly positioned on a "one way" street. With this invention, right angle dumping into a receiving vehicle can also be accomplished with both the sweeping and receiving vehicle being positioned at an intersection of streets with two-way traffic while only occupying one curb lane on each street.

Still another feature of this invention concerns the automatic repositioning of the dirt-conveying mechanism when a dump sequence is started. In order for a belt-type conveyor to fill a container, it is necessary that the conveyor belt extend into that container to eliminate spillage. With this invention, a pivot linkage is provided which enables the conveyor to be moved slightly rearward as the hopper begins to elevate to avoid interference with the dirt hopper as the dirt hopper is moved through its dumping cycle. A simple, positive rugged, mechanical linkage is provided which moves the conveyor assembly up and rearward as the dump sequence starts and then automatically moves the conveyor assembly back to its transport or sweep position as the dumping cycle is completed.

Yet, another object is to provide a street sweeper and systems therefor that can be powered by a single engine for energy and cost savings.

A further feature of this invention is to provide a sweeper with counter-balancing means to minimize the possibility of tipping of the sweeper during its dumping cycle.

Other features of this invention concern a self-propelled four-wheeled street sweeping machine including a frame supported by front and rear axles with four wheels. A cab is supported by the frame at its forward end. A dirt receiving hopper is positioned behind the cab and has its weight uniformly distributed over the axles. A conveyor is positioned adjacent the hopper and has an upper end overlying the hopper for depositing materials picked up from a roadway into the hopper and with the conveyor being pivotally mounted at its lower end on said frame. Ram operated linkage means is provided for rotating the hopper off of said frame from behind said cab over said cab for unloading. Linkage is connected between the hopper lift means and the conveyor for pivoting the conveyor on its pivot so that its upper end moves clear of the hopper.

Other objects and features of this invention will more fully become apparent in view of the following detailed description of the drawings which show several embodiments and in which.

Figures 1, 4:
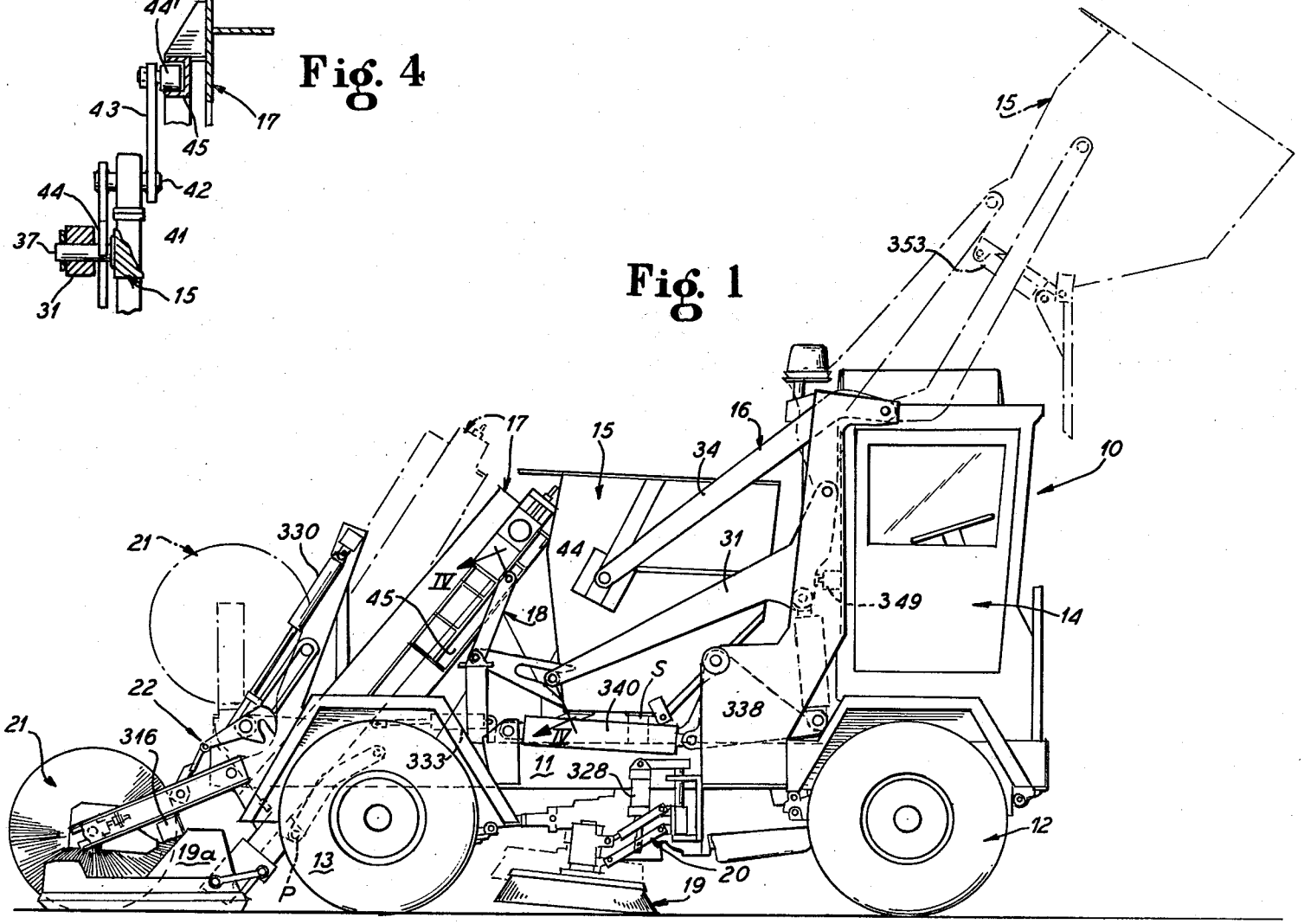
FIG. 1 is a side elevation of a street sweeper with certain parts shown in full and dotted lines for the purpose of illustrating the manner of operation of various components therefor.
FIG. 4 is a fragmentary cross sectional view taken substantially on the line IV—IV looking in the direction indicated by the arrow as shown in FIG. 1.
Figure 2:
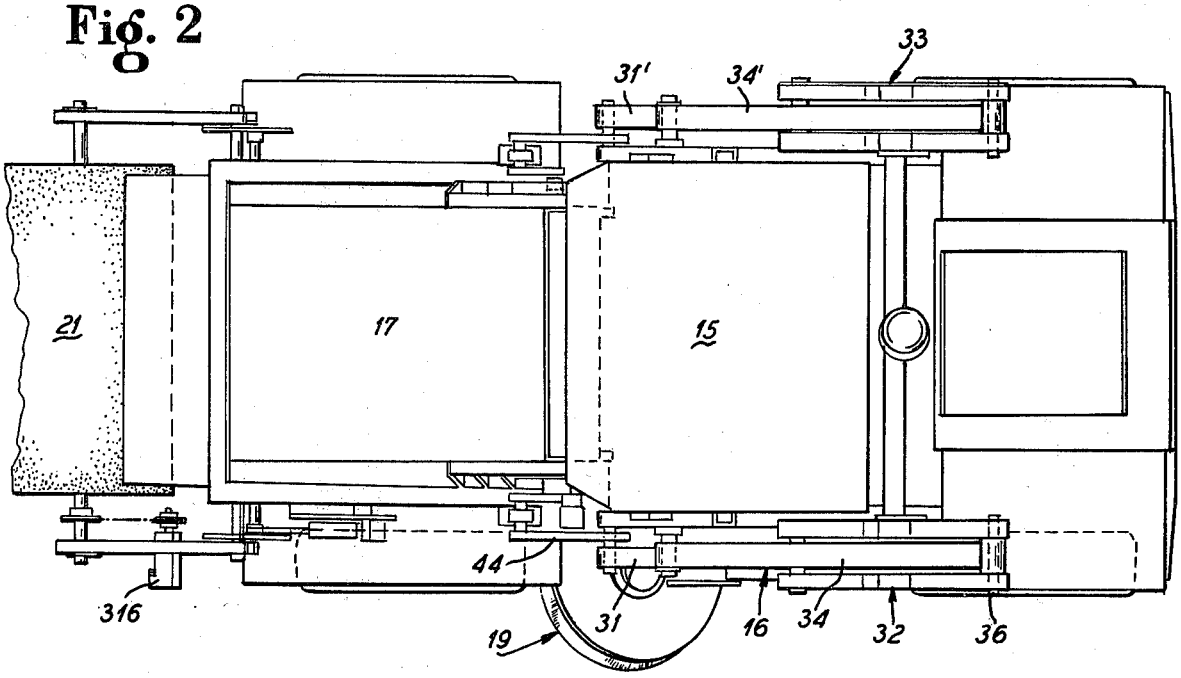
FIG. 2 is a fragmentary top plan view of the street sweeper shown in FIG. 1.

The reference numeral 10 indicates generally a self-propelled, four-wheeled street sweeper of the type that is particularly adapted to travel at high speeds on the open highways when loaded or unloaded and which is also capable of operating at slower speeds when sweeping the streets. The street sweeper 10 includes a main frame 11 that is supported by a front axle mounted on a pair of front wheels 12 and a rear axle mounted on a pair of rear wheels 13. An operator's cab 14 is disposed at the front end of the sweeper 10 above a single engine. Immediately behind the cab is a dirt hopper 15 that is ordinarily supported on the main frame 11 when positioned to receiving sweepings and which is elevatable over the cab for unloading the sweepings from the hopper. A powered hopper elevating mechanism 16 is provided for moving the dirt hopper in an arc from its sweeping receiving position behind the cab to its dumping position over the cab 14. Before the mechanism 16 can be operated, outriggers 23,23 are operated through the controls to provide support for the cab end or forward end of the sweeper for the time when the hopper 15 is elevated over the cab as will be more fully described in connection with the description of the hydraulic circuit that follows and as also described in assignee's U.S. application for patent entitled "Street Sweeper Having an Elevating Hopper with Supporting Outriggers", Our Case P762177, U.S. Ser. No. 966,494.

Shiftably mounted on the frame immediately behind the dirt hopper 15 is a tiltable sweepings conveyor 17. The conveyor 17 is adapted to transport sweepings from ground level to an elevated position into the hopper 15 when the hopper is positioned for receiving the sweepings. Pivotal linkage means 18 is provided for tilting a conveyor 17 to move its upper end so the hopper may be moved through its arc while supported by the powered hopper elevating mechanism 16 free of interference with the conveyor 17.

Supported on a frame 11 at its opposite sides are a pair of side brooms 19. If desired, only one side broom can be used. The pivotal linkage 18 for tilting the conveyor 17 is operated by the powered hopper elevating mechanism 16. Means 20 is provided for moving the side brooms from a transport position to a sweeping position. When in a sweeping position, the brooms 19 are rotatable to throw sweepings from the gutter into the path of main broom 21. Main broom 21 is rotatable to throw the sweepings onto conveyor 17 and the conveyor cleats are adapted to transport the sweepings and unload the same into the dirt hopper 15 in a conventional manner.

Positioned at the rear end of the sweeper 10 is a main broom 21. Means 22 including powered linkage 330 is provided for moving the main broom 21 alternatively from a transport position to a sweeping position.

The sweeper 10 is provided with a pair of hydraulic rams 333,333 for raising and lowering the conveyor from a road traveling position to a sweeping position. This control is shown in the hydraulic circuit (FIG. 8) hereafter described.

Figure 5:
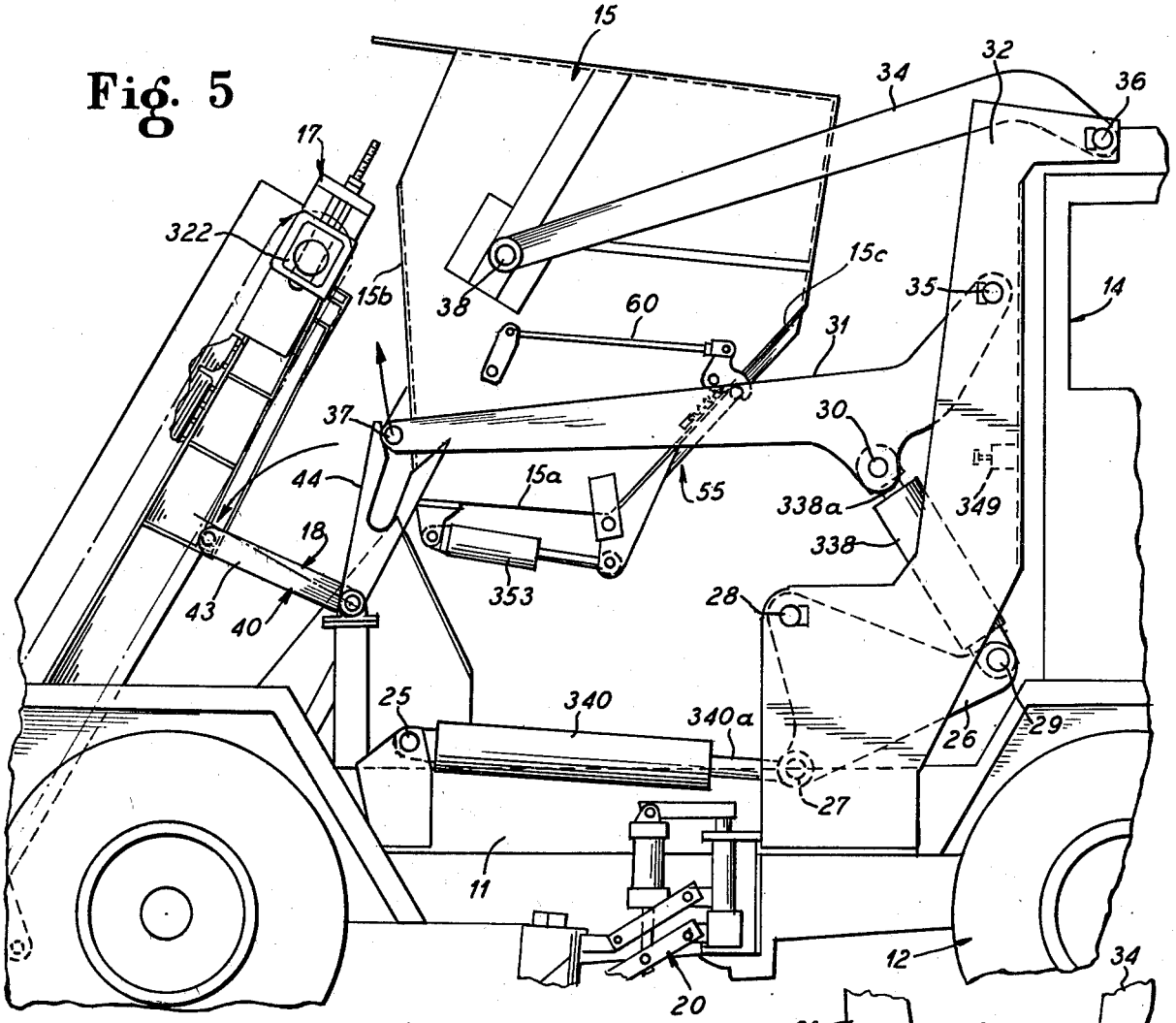
FIG. 5 is an enlarged fragmentary side view of the sweeper shown in FIG. 1 illustrating the operation of various components during the dumping cycle.
Figure 8:
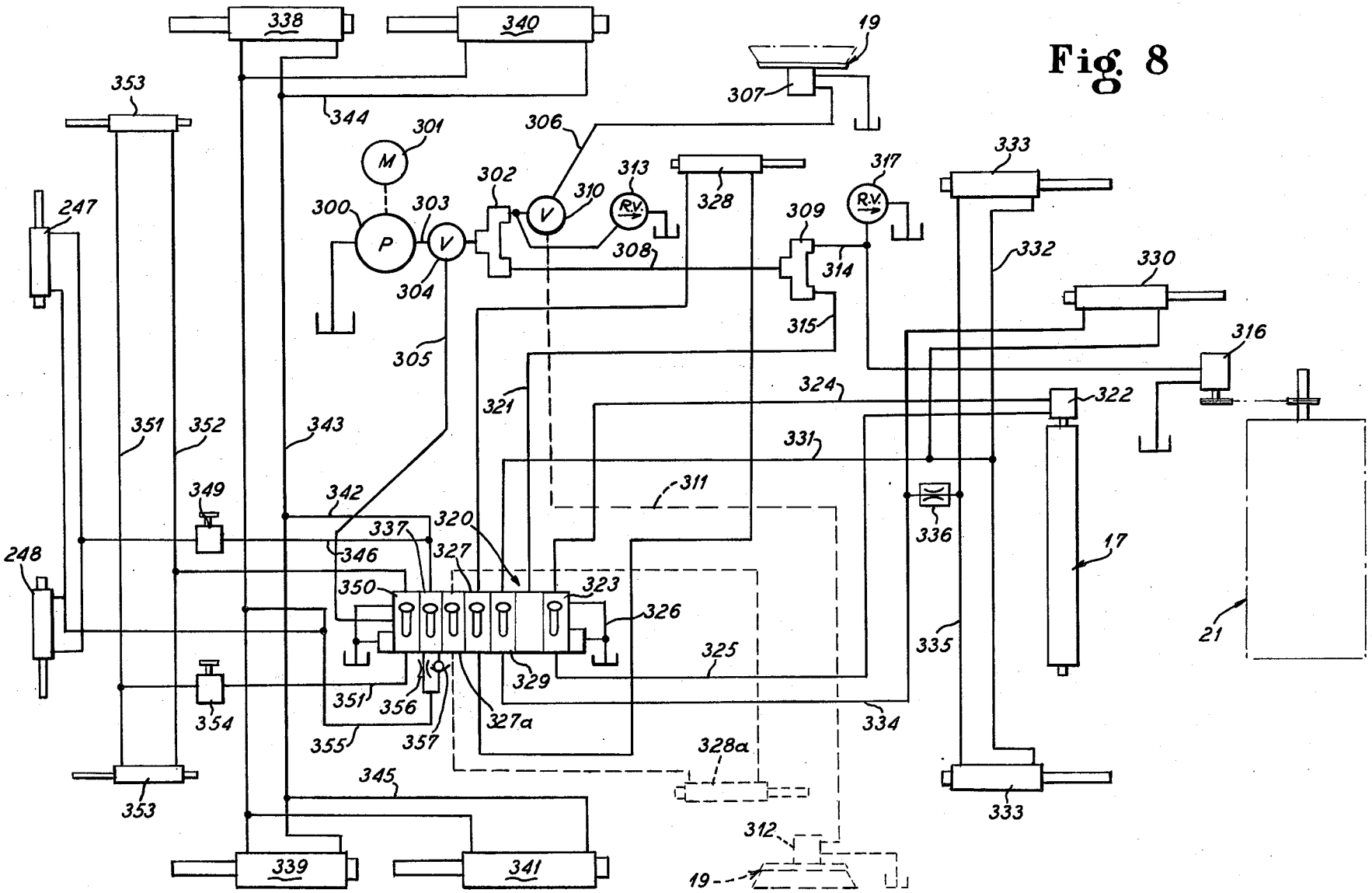
FIG. 8 is a diagrammatic view of the hydraulic circuit used in the operation of the sweeper shown in FIG. 1.

The powered hopper elevating mechanism 16 for moving the hopper for dumping includes two pairs of coacting cylinders with the first pair being identified as 338 and 340 in FIG. 5 and with the other pair 339 and 341 being shown in the hydraulic circuit in FIG. 8. Since the operation of the cylinders 338 and 340 with the other components of the powered hopper elevating mechanism 16 are identical a description of the manner of operation of one side of the machine will suffice for the other side. Hand operated controls for operating the hydraulic cylinders are located in the cab for the operator and these are also shown in FIG. 8 and described with the description of the hydraulic circuit. It will be appreciated that other improvements to the machine 10 are being more fully disclosed in other companion patent applications being filed by the assignee, including the application entitled "Spring Suspended Street Sweeper Having Rear Axle Spring Lockout", Our Case No. P761975, U.S. Ser. No. 940,560.

The ram or cylinder 340 is pivotally mounted on the frame 11 at 25 (FIG. 5) at one end, and its ram end **340*a* is pivotally connected to pivoting plate 26 at 27. The plate is pivotally mounted on the frame 11 at 28, and hence when the ram 340a extends, the plate 26 swings about its pivot 28 to cause ram 338 to move up and down depending on the direction of movement of the ram 340a. The ram 338a is pivotally connected to the plate at 29 and has its ram operating end 338a pivotally connected at 30 to a lower swing arm 31**.

Figure 3:
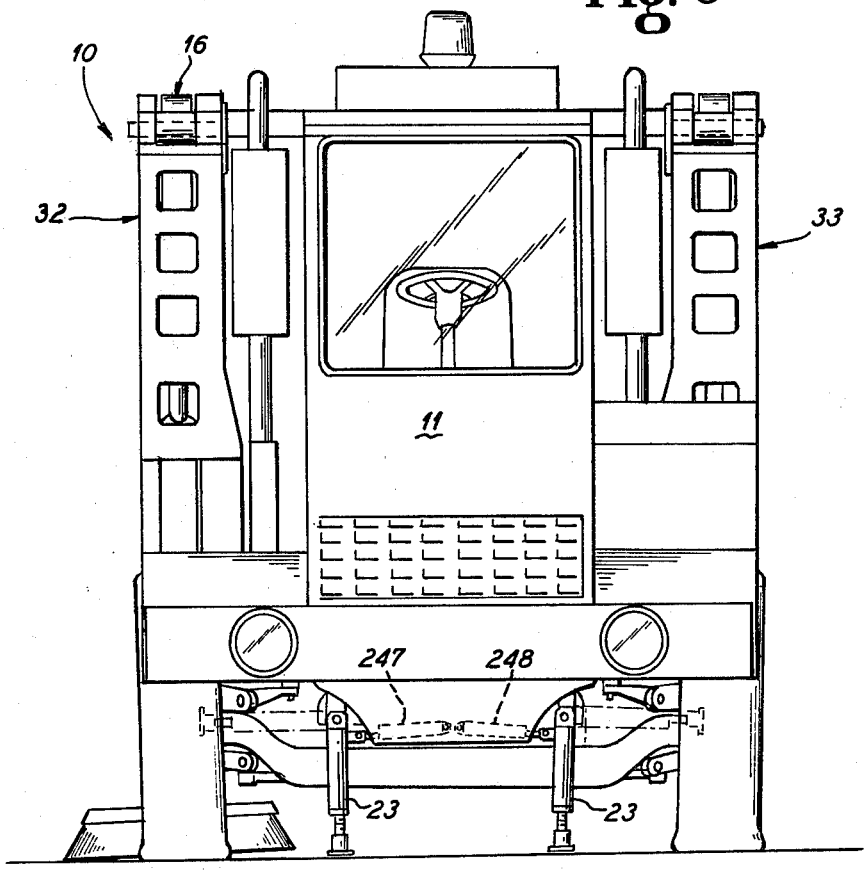
FIG. 3 is a front view of the street sweeper shown in FIG. 1.

Mounted on the frame on opposite sides of the cab 14 are upright frame extensions or posts 32 and 33 (FIG. 3). These posts provide the supports of a pair of parallel swing arms 31 and 34 with the swing arm 31 being pivotally mounted on the post 32 at 35 and with the swing arm 34 being pivotally mounted on the posts 32 at 36. Opposite ends of the swing arms 31 and 34 are pivotally connected to the hopper 15 at 37 and 38 respectively. Thus, as the cylinders 340 and 338 are operated, the hopper 15 can be cause to be lifted off the frame 11 and moved through an arc over the cab so that the contents of the hopper 15 can be dumped. As stated before, only one set of the arms 31 and 34 are shown on one side of the hopper 15, and the corresponding parallel swing arms 31' and 34' on the opposite side of the hopper are identical and similarly operable by a separate pair of rams 339 and 341.

As previously discussed herein, the conveyor 17 and its upper end is normally positioned in overlying relation with respect to the hopper 15 when the hopper is seated on the frame 11 as is shown in FIG. 1. It is in this way that the conveyor 17 can be operated to cause swept particles gathered by the brooms 21 and 19 to be moved into the dirt hopper 15. When the hopper has been filled, it is desired to unload the hopper and the conveyor 17 must be tilted on a pivot P. The full and dotted line positions of the conveyor 17 are shown in FIG. 1 for the purpose of showing the conveyor in a sweeping position and then in a hopper unloading position. The conveyor 17 is shown in its unloading position in FIGS. 5 and 6.

In order to tilt the conveyor 17 on its pivot P, the powered linkage 18 for tilting a conveyor is provided. This linkage comprises a pair of bell crank levers 40,40 with only one of them being shown. The bell crank lever 40 is mounted on the frame on a post 41 at bell crank pivot 42. The bell crank lever 40 includes a pair of bell crank lever arms 43 and 44 with the bell crank arm 43 being connected to rollers 44' (FIG. 4) and mounted in conveyor guide channel 45 (only one shown) on a stationary or underside of the conveyor 17. When the rollers 44 are in a down position (FIG. 5), the upper end of the conveyor 15 is tilted longitudinally or rearwardly away from the cab to provide clearance space so the hopper can move up and down without contacting the conveyor, and the conveyor is then in its dumping position. When the rollers 44' are in an upper position on the channel 45 (FIG. 1), the upper end of the conveyor 15 is in its transport or sweeping position.

Figures 7, 9, 10:
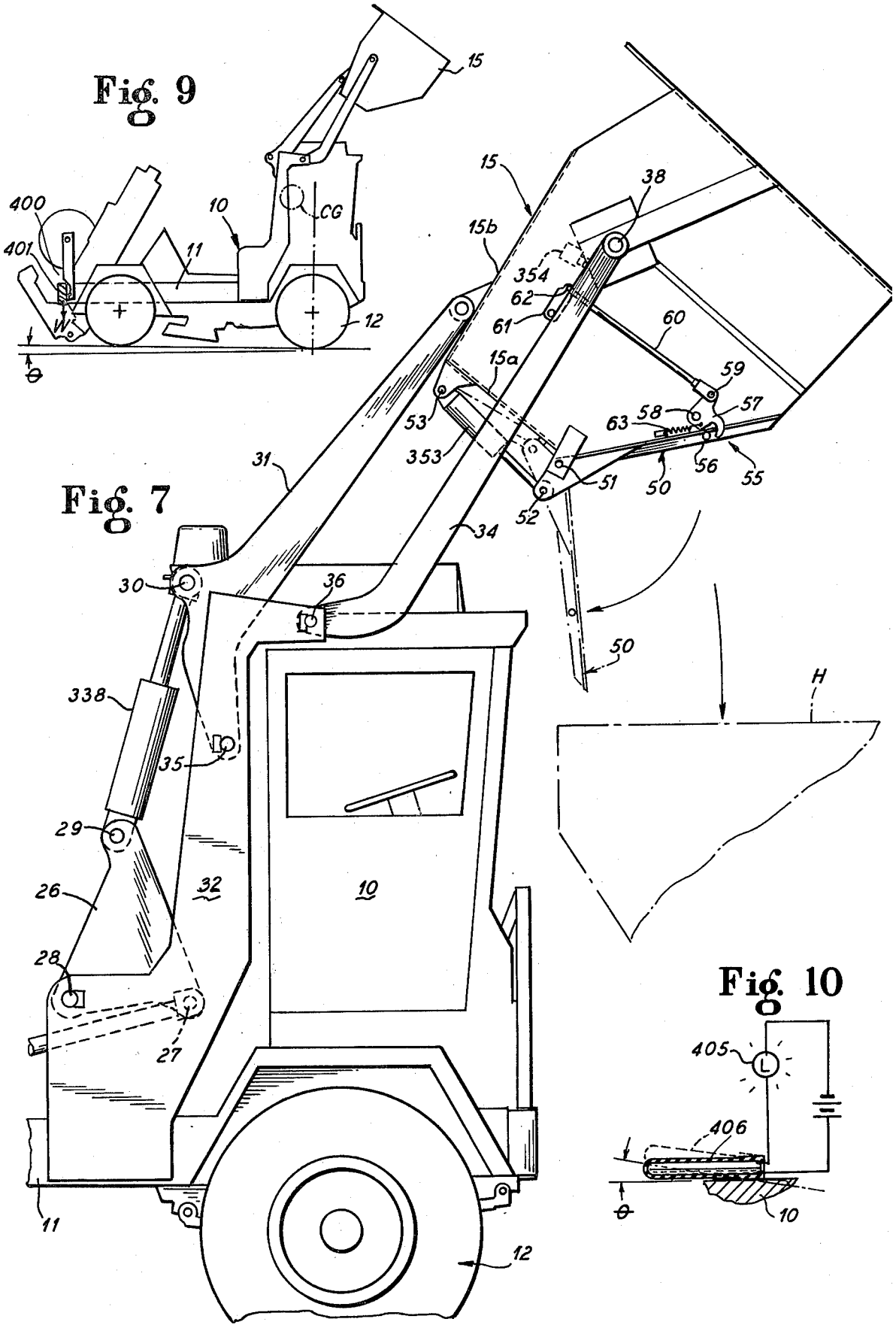
FIG. 7 is an enlarged fragmentary side view of the street sweeper showing the sweeper and its hopper in a dump position relative to a dump.
FIG. 9 is a diagrammatic view of a sweeper illustrating a modified counter-balancing apparatus.
FIG. 10 is a diagrammatic view of the modified counter-balancing circuit, as illustrated in FIG. 9.

Provided on the hopper 15 is a hopper door 50. The hopper door is pivotally mounted at 51 on the hopper 15. The ram 353 is connected to the door 50 in adjacency to the door pivot 51 as indicated at 52 so that when the cylinder is operated, the door can pivot on its pivot 51 into an open position as shown in FIG. 7. In connection with this pivoting action, since the cylinder 353 is pivotally mounted to the hopper at 53, the cylinder is free to move on this pivot as the door 50 is moved from a closed position to an open position which relationship is shown in the full and dotted lines in FIG. 7. For the purpose of insuring that the hopper door 50 remains closed, a door lock 52 is provided on opposite sides of the hopper 15. The door itself has a lug 56 on opposite sides and a pivotally mounted keeper 57 coacts with the lug 56 to secure the door in a locked position. It will be seen that the latch keeper is pivoted to the hopper at 58 and is also pivotally connected at 59 to a mechanically actuatable lock actuator 60 which mechanically opens the latch when swing arms 34 and 34' reach a position over the cab at which the hopper door is in front of the cab. At this position, swing arms 34 and 34' engage pin lever 61 pivoted at 62 on the hopper which pulls lock actuator 60 to unlatch the door. A spring 63 returns the latch to a locked position when the hopper begins to return to the sweeping position and swing arms 34 and 34' come out of contact with pin lever 61. As will be evident from the hydraulic circuit description that follows, the hopper door 50 can only be opened after the hopper 15 has been moved to its dumping position over the cab. With this safety feature, the contents of the hopper cannot be dumped onto the cab or the remainder of the sweeper as the hopper is moved from its position on the frame for receiving sweepings to its dumping position for dump into hopper H.

Operation of Hydraulic Circuit Concerning the Sweeper Components

Referring now to FIG. 8 of the drawings, it will be seen that during the street sweeping operation, a hydraulic pump 300, driven by a suitable motor 301, delivers pressurized hydraulic fluid to a flow divider 302 by way of a pressure line 303. A three-way valve 304, located in the line 303, provides for diverting the pressurized hydraulic fluid to a by-pass line 305 during a nonsweeping phase of machine operation, as will be described later. The flow divider 302 is arranged to proportionally divide the hydraulic fluid produced by the pump 300 between a line 306, connected to a side broom fluid motor 307 for the right-hand side broom 19, and a line 308 connected to a second flow divider 309. Optionally, when a second broom 19 is desired for use on the left-hand side of the sweeper, a three-way valve 310 in the line 306 to divert the divided hydraulic fluid flow from the right-hand side broom motor 307 to a left line 311 is connected to a left-hand side broom motor 312 (shown in broken lines). Thus, the proportioned pressure fluid in the line 306 is utilized to rotatably drive the side brooms as required. A relief valve 313 is provided in the line 306 for the overload protection of the fluid motor 307, and the fluid motor 312 when used.

Pressure fluid in the line 308 is again proportionally divided by the flow divider 309 between the pressure lines 314 and 315 in accordance with fluid flow requirements. Herein, hydraulic fluid in the line 314 serves to power the main broom fluid motor 316 which is drivably connected to the main broom 21 at the rear of the sweeper. A relief valve 317 is provided in the line 314 for the overload protector of the fluid motor 316. The proportional fluid flow in the line 315 is delivered to a control valve bank 320 by means of a pressure line 321 for powering a reversible fluid motor 322 which serves to drive the sweeper's conveyor 17. A control valve 323 (for conveyor rotation) of the valve bank 320 is operably arranged to deliver pressurized hydraulic fluid to the motor 322 by way of a line 324 or optionally by way of a line 325. The valve 323 is a two-position valve with no "neutral" position. The valve activating lever is spring loaded for the "forward" direction of conveyor operation. It can be manually held in the "reverse" position but upon release, returns immediately to the "forward" position. Valve 323 could be an "open center" valve with a "neutral" position and the system would function satisfactorily. The reason that this type of valve was not used with our control was to eliminate the necessity of the sweeper operator having to activate an additional valve handle in order to begin the sweeping operation. Thus, the conveyor motor 322 may be driven in a reverse direction where required as for example in the event of a clogged or stalled conveyor chain or belt. Obviously, when the line 324 is pressurized to drive the conveyor chain or belt in a forward or loading direction, the line 325 serves as the return line connected with a tank line 326 by means of internal parting in the valve 323. Further, when the motor is reversed and line 325 becomes the pressure drive line, the line 324 returns the hydraulic fluid to tank by way of the valve 323. Thus, it will be appreciated that each of the fluid motors 307, 316 and 322 is supplied with a proportioned volume of pressurized fluid by the use of the flow divider 302 and 309 to drive the side broom 19, rear main broom 21 and the conveyor 17, all at related compatible speeds to provide an optimum sweeping action for the machine while utilizing a single hydraulic pump.

When the sweeping operation is to be stopped and the machine is to be driven to dump site or to an overnight parking area, the side and main brooms 19 and 21 are retracted from contact with the street surface and the conveyor is stopped. Herein, the three-way valve 304 is operated to bypass the entire pump output to the line 305 which cuts off pressure flow to the fluid motors 307 or 312 when used, 316 and 322. The full output of the pump 300 is made available to the valve bank 320 by way of the line 305. Accordingly, a sufficiently high volume of pressurized hydraulic fluid is available to power the various hydraulic cylinders for rapid and responsive control of the various machine functions, which are not operated during the street sweeping operation of the machine.

A valve 327 or **327*a* is actuated to direct pressurized fluid to cylinder 328 or 328*a* to raise the side broom 19 to a nonoperative, traveling position and a valve 329 is also actuated to charge cylinder 330 to raise the rear main broom 21 for travel. The valve 329 is also effective to raise the conveyor 17 a suitable clearance distance off of the pavement along with its dust deflector frame 19*a***.

In FIG. 8, it will be seen that the valve 329 is connected to the cylinder 330 by a fluid line 331 with a branch line 332 connected to a pair of cylinders 333 which are operatively pressurized to raise the conveyor 17. A second fluid line 334 is connected to the cylinder 330 to provide a return flow passage for hydraulic fluid back to tank by way of internal parting of the valve 329. A branch line 335 is also connected to the pair of cylinders 333 for returning hydraulic fluid to tank. Thus, when retracting the main broom 11, along with the conveyor 17, fluid is directed to the cylinder 330 by way of pressure line 331 and to the conveyor tilt cylinders 333 by way of the branch line 332. Hydraulic fluid expelled from the cylinder 330 returns to tank by way of line 334, and fluid expelled from the cylinders 333 is returned to tank by way of the branch line 335 to the line 334 and the valve 329. A flow restrictor 336 is interposed between the lines 335 and 334 to retard the movements of the conveyor tilt cylinders 333. Herein, since the single valve 329 is used to control the movements of both the main broom 19 and the conveyor 17, and since the pressures required to swing the broom 19 are substantially greater than the pressures to move the conveyor 17, especially initially in a lowering direction, the restrictor 336 thus serves to insure that all of the cylinders are suitably operative under the varying pressure demands of the elevating and retracting movements of the main broom and the conveyor 17. Now, when the hopper 15 is to be emptied, a valve 337 is activated to pressurize lift cylinders 338, 339, 340 and 341 by way of fluid lines 342, 343, 344 and 345, to elevate the hopper 15 to the dump position shown in FIG. 7. At the same time, a branch line 346, connected to the pressure line 342, directs pressurized hydraulic fluid to a pair of outrigger cylinders 247 and 248 with the actuation of the valve 337. The outrigger cylinders 247 and 248 are arranged to "set" a pair of front outrigger members in a ground supporting orientation to stabilize the front end of the sweeper 10, prior to lifting the hopper. At the start of the hopper dump cycle and with the hopper still resting on its lower supporting stop "S" the lower lift arm 31 contacts a two-way valve 349 connected in the fluid line 346, to hold it in an open, fluid passing position against a biasing spring urging the valve to a closed or blocked position. Thus, when the valve 337 is first activated, the initial pressure flow is directed to the outrigger cylinders 247, 248 by way of line 342, branch line 346 and through the open two-way valve 349. This is in accordance with the pressure requirements of the system since the minimal pressure required to extend the outrigger cylinders 247 and 248 to "set" the front outriggers 23,23 is substantially less than the pressure required to elevate the hopper 15.

After the outrigger cylinders 247, 248 are fully extended and the pressure in this portion of the hydraulic circuit increases sufficiently, the lift cylinders extend to lift the hopper 15. Shortly after the hopper begins to raise, the lower lift arm 31 moves out of contact with the two-way valve 349, allowing it to close and lock the outriggers 23,23 in their support position.

Figure 6:
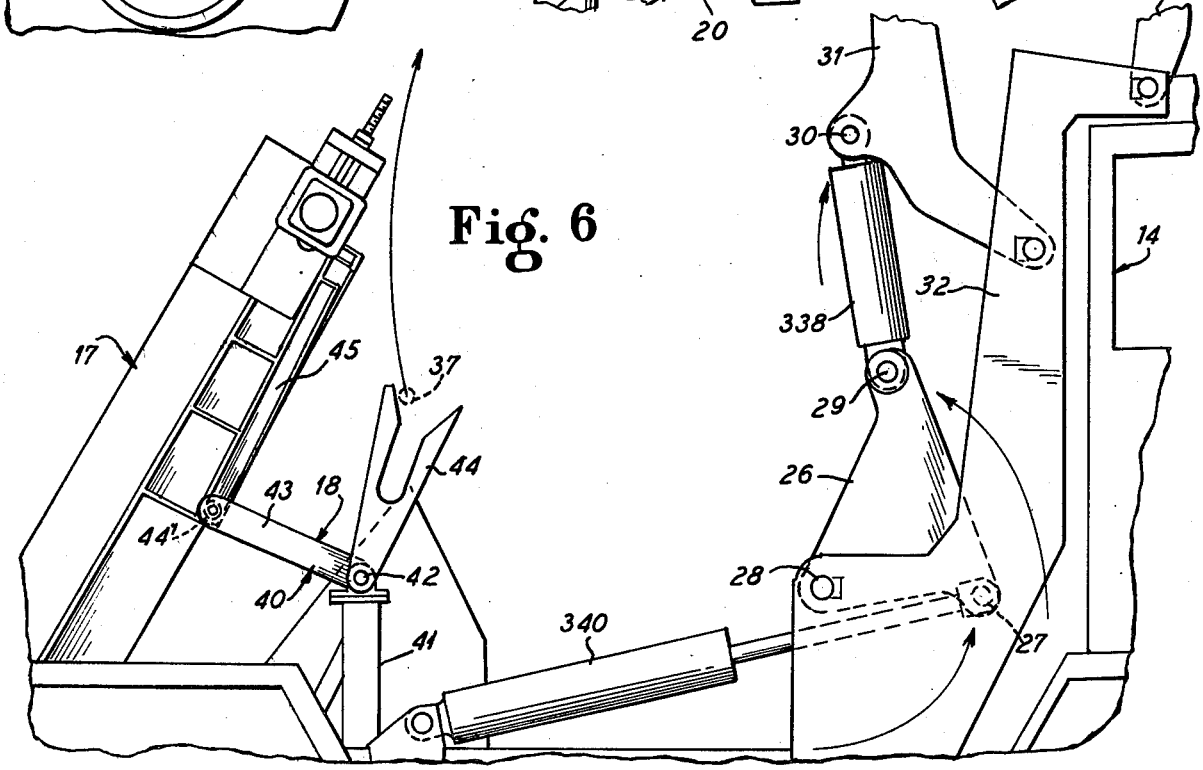
FIG. 6 is an enlarged fragmentary view similar to FIG. 5 only illustrating the dumping cycle in still another stage of operation.

The outriggers 23,23 are thus maintained in their support position throughout the rest of the hopper elevating and lowering cycles until again the lower lift arm 31 makes operative contact with the two-way valve when the hopper comes to rest on its stop S. Only then with continued operation of the valve 337, will the outrigger cylinders be retracted and the front of the sweeper again be supported by the springs for the front wheels 12. As best seen in FIG. 5 of the drawings, the lower lift cylinders 338, 339 initially produce the lifting movement in the hopper 15 because of the mechanical advantage provided by geometry of the elevating swing linkage 16 and which is further responsible for the tilting of the upper conveyor discharge end to its clearance position relative to the hopper to provide clearance for swinging movement therepast, as previously described. After the lower lift cylinders 340, 341 raise the elevating linkage 16 (see FIG. 5) to a position in which the geometry provides a generally equal force component as experienced by the upper lift cylinders 338,339 with the elevating forces produced to raise the lower lift cylinders 340,341, all of the elevating cylinders are then employed to complete the hopper travel to its full dump position (FIG. 6).

According to other features of this invention, it will be seen from a comparative study of FIGS. 5 and 7 of the drawings that the hopper has a bottom **15*a* that is normally supported in a horizontal plane on the frame 11 (FIG. 1). The hopper 15 further has an inclined forward wall bearing the dump door 55. The hydraulically operated linkage for moving the hopper through an arc including the swing arms 31 and 34 are effective to maintain the hopper bottom 15***a* in an essentially horizontal plane until the hopper is moved in its arc to a position over the cab. Importantly, as the linkage and the swing arms 31 and 34 further move the hopper 15 further over the cab and then forwardly of the cab as shown in FIG. 7, the linkage is effective to cause the hopper bottom 15*a* to move in its arc to forwardly tip the hopper so that the hopper bottom is moved to an inclined position of approximately 45 degrees, thereby shifting the relative position of the dump door forwardly for enabling the contents of the hopper to be completely discharged on the opening of the dump door as shown in FIG. 7. It will further be seen from FIG. 5 that the pairs of swing arms 31 and 34 on each side of the hopper 15 are in a nonparallel position relative to one another. Also, it will be seen from a study of FIG. 7 that the swing arms 34 are suitably connected to the opposite sides of the hopper at 38 whereas the swing arms 31,31 are suitably connected to a forward downwardly inclined or slanted wall 15*b* of the hopper. The wall 15*b* is slanted at about a 97 degree angle relative to the hopper bottom 15 to minimize the amount of clearance space required for the upper end of the conveyor to be moved to allow for the upwardly lifting of the hopper 15 to unload the same. The hopper 15 is further provided with a slanted forward wall 15*c* which carries the dump or hopper door 55. The forward slanted wall of the hopper is slanted at about a 50 degree angle relative to the hopper bottom 15*b*. The relationship between the forward wall of the hopper and the bottom wall of the hopper is calculated to enable the total contents of the hopper to be easily discharged from the hopper. The hopper has a volumetric capacity of 3.3 cubic yards and is designed to carry a load of approximately 3,000 pounds per cubic yard or 9,000 pounds of sweepings. In view of the heavy load carried by the hopper, it is, of course, important that the hopper door be tightly locked until the hopper is moved forward of the cab to its unloading position and the sweeper is also provided with the counterbalancing means for enabling the heavy load in the hopper to be shifted from its travel position forwardly of the cab to its dumping position while maintaining the sweeper in a stabilized condition.

According to our method of operating the street sweeper, it will be appreciated that it can be operated in such a way that relative movement of the conveyor can be brought about in a longitudinal direction away from the cab to provide a clearance space to permit the dirt hopper 15 to be elevated or upwardly swung through the space transversely over the top of the cab to the dumping position. A sequence of movements are so timed that the longitudinal movement of the upper end of the conveyor generates the clearance space as the conveyor pivots to the linkage pivot point 42. After the contents of the hopper have been dumped, the hopper 15 can be returned to its original transport position and remounted on the support pads S. The support pads are positioned transversely on the frame 11 and coact with the swing arms 31 and 34, and the other coordinating ram to secure the hopper 15 on the frame in a stabilized transport position.

Now, with specific reference to FIGS. 7 and 8 of the drawings, a valve member 350 of the valve bank 320 is operative to open the dump door 50 of the hopper 15, but only when the hopper has reached its full dump position. Herein, a pair of fluid lines 351, 352 are connected between the valve 350 and a pair of hopper door cylinders 353 with a two-way valve 354, similar to the two-way valve 349 provided in the line 351 to block flow to the cylinders until the spring closed valve 354 is opened by contact with the upper lift arm 34. This contact occurs when the hopper is raised to its full dump position, thereafter the operation of the valve 350 is effective to retract the cylinders 353 to drop the hopper door 50 as shown in broken lines in FIG. 7. After the waste material in the hopper has been dumped, the cylinders are again extended to close the hopper door 50. The hopper may then be returned to its FIG. 1 position, ready again to receive sweepings by operation of the valve 337. The valve opening contact between the upper lift arm 34 and the two-way valve 354 is broken with the first lowering swing movement of the hopper, whereby the dump door 50 cannot accidently be opened.

Thus, it may be seen that one hydraulic pump and a minimum number of operating valves are required to fully control all the operations of the machine in a single and responsive fluid pressure system.

In FIGS. 9 and 10, there is shown a modified counterbalancing system. To this end, the sweeper 10 has a rear frame cross member 400 that has been changed from a channel section to a solid section as indicated at 401 to provide a counterweight W when dumping the hopper 15. This counterweight is intended to be used in place of the automatic front outriggers 23,23. The combination of a counterweight, and exterior sheet metal weight are sufficient for safe dumping of a loaded hopper 15 on a 5 percent down slope. When the bucket is resting on the machine, the center of gravity is centrally located on the frame 11 between the axles. When the hopper 15 is elevated, the center of gravity, CG, moves forward and upwardly (FIG. 9) and close to the front axle and so by adding the weight W, the center of gravity, CG, can be maintained rearward of the front axle. A warning light 405 (FIG. 10) is provided in the cab and is illuminated if the operator attempts to dump the hopper on an unsafe slope such as one that exceeds 5 degrees downslope, as an example. In order to limit the slope at which an operator might attempt to dump, a mercury electrical switch 406 has been provided. This switch actuates the warning light 405 when the operator attempts a dump on a downhill grade exceeding a predetermined percent such as 5 percent, as an example. When the mercury electrical switch 406 is tipped as shown in FIG. 10, the contacts are closed and the lamp is lit which relationship is indicated in the dotted line position shown there in FIG. 10.

We claim as our invention:

1. A street sweeper having a frame, a cab positioned at a forward end of the frame, main and side brooms on the frame behind the cab, a hopper for receiving sweepings positioned on the frame behind the cab, means on the frame behind the cab for loading sweepings from the main and side brooms in the hopper and hydraulically operated linkage for moving the hopper through an arc over the cab to a dumping position for unloading sweepings into a truck at a forward end of the sweeper.

2. The sweeper of claim 1 further characterized by said means comprising a conveyor being pivotally mounted on said frame and having an upper end overlying said hopper for depositing sweepings therein, and means cooperable with said hydraulically operated linkage for pivoting the upper end of said conveyor on its pivot out of overlying relation relative to the hopper to enable the hopper to be elevated free of interference with the conveyor.

3. The sweeper of claim 1 further characterized by said linkage including a pair of swing arms on each side of said hopper pivotally connected to said frame and to said hopper, and a pair of first and second rams and a pivoting plate cooperable with each of said pairs of swing arms, the first ram being connected to said frame and to said pivoting plate for pivoting said plate on said frame and lifting said hopper off of said frame, and said second ram being pivotally connected to said pivoting plate and movable therewith and also being connected to one of said swing arms for lifting said hopper over said cab into dumping position.

4. The sweeper of claim 1 further characterized by said linkage including a pair of swing arms on each side of said hopper pivotally connected to said frame and to said hopper, and a pair of first and second rams and a pivoting plate cooperable with each of said pairs of swing arms, the first ram being connected to said frame and to said pivoting plate for pivoting said plate on said frame and lifting said hopper off of said frame, and said second ram being pivotally connected to said pivoting plate and movable therewith and also being connected to one of said swing arms for lifting said hopper over said cab into dumping position, said means comprising a conveyor being pivotally mounted on said frame and having an upper end overlying said hopper for depositing sweepings therein, and means actuatable by one of said swing arms for pivoting the upper end of said conveyor on its pivot out of overlying relation relative to the hopper to enable the hopper to be elevated free of interference with the conveyor.

5. A street sweeping machine including a wheeled frame, a cab supported by said frame, a dirt receiving hopper positioned behind said cab, a conveyor positioned adjacent said hopper and having an upper end overlying said hopper for depositing materials picked up from a roadway into the hopper, the conveyor being pivotally mounted for movement relative to said hopper and said frame, hopper lift means for rotating the hopper off of said frame from behind said cab over said cab for unloading of the picked-up materials in the hopper at a forward end of said cab, linkage connected between said hopper lift means and said conveyor for pivoting said conveyor on its pivot so that its upper end moves clear from its position of overlying said hopper to allow said hopper lift means to rotate the hopper free of interference from said conveyor during the lifting movement of said hopper, and ram means for operating said hopper lift means to rotate the hopper from a loaded position over the cab to permit said hopper to be unloaded forward of said cab.

6. A street sweeper having a frame, a cab positioned at a forward end of the frame, main and said brooms on the frame behind the cab, a hopper for receiving sweepings positioned on the frame behind the cab, means on the frame behind the cab for loading sweepings from the main and side brooms in the hopper, and hydraulically operated linkage for moving the hopper through an arc over the cab to a dumping position for unloading sweepings into a truck at a forward end of the sweeper, and a single engine for powering the sweeping machine and also for providing the power for said hydraulically operated linkage.

7. The machine of claim 5 further characterized as including means cooperable with said frame to stabilize the frame to minimize any tending for the machine to tip when said hopper is in a dumping position over said cab.

8. The machine of claim 1 further characterized as including means cooperable with said frame to stabilize the frame to minimize any tending for the machine to tip when said hopper is in a dumping position over said cab.

9. The machine of claim 1 further characterized by said hopper having a dump door, and actuating means for opening and shutting said dump door only when said hopper reaches its dumping position to prohibit accidental spillage of the sweepings onto the cab.

10. The sweeper of claim 1 further characterized by said linkage including a pair of upper-and-lower swing arms on each side of said hopper pivotally connected to said frame and to said hopper, and a pair of first and second rams and a pivoting plate cooperable with each of said pairs of swing arms, said pivoting plate having a pivotal connection joining said pivoting plate to said frame, the first ram being connected to said frame and to said pivoting plate for pivoting said plate on its pivotal connection and lifting said hopper off of said frame, and said second ram being pivotally connected to said pivoting plate and swingable with said pivoting plate as said plate is rotated and said second ram also being connected to said lower swing arm for lifting said hopper over said cab into a dumping position.

11. The sweeper of claim 1 further characterized by the hopper having a bottom for supporting the hopper on the frame and an inclined forward wall bearing a dump door, hydraulically operated linkage being effective to maintain the hopper bottom in an essentially horizontal plane until the hopper is moved in its arc to a position over the cab whereupon the linkage operates to forwardly tip the hopper so that the hopper bottom is moved to an inclined position of approximately 45 degrees, thereby shifting the relative position of the dump door fowardly for enabling the contents of the hopper to be completely discharged on the opening of the dump door.

12. The sweeper of claim 1 further characterized by said means comprising a conveyor being pivotally mounted on said frame and having an upper end overlying said hopper for depositing sweepings therein, and means cooperable with said hydraulically operated linkage for pivoting the upper end of said conveyor on its pivot out of overlying relation relative to the hopper to enable the hopper to be elevated free of interference with the conveyor, said means comprising a pair of pivotally mounted bell crank levers on opposite sides of said hopper each with one arm connected to said hydraulically operated linkage, a pair of roller slide means connected to said conveyor and to another bell crank arm to assist in tilting of said conveyor.

13. The sweeper of claim 1 further characterized by having a pair of supports on which the hopper rests when the hopper is in its transport position.

14. In a method of operating a street sweeper having a cab at one end, a dirt conveyor adjoining the other end and an intermediate dirt hopper, the steps of relatively moving the conveyor in a longitudinal direction away from the cab to provide a clearance space and swinging the hopper upwardly through such space and traversely over the top of the cab to a dumping position.

15. The method of claim 14 further characterized by timing the sequence of movements so that the longitudinal movement of the conveyor pivots the conveyor away from the intermediate dump box to provide the clearance space for the hopper to be swung upwardly and then over the cab.

16. In a method of claim 14 further characterized by providing a linkage pivot point beneath the conveyor and pivoting the conveyor at its base on the linkage pivot point as the dirt hopper is elevated to provide a clearance space and lifting the dirt hopper upwardly through such space upwardly and forwardly over the top of the cab to a dumping position.

17. The method of claim 16 further characterized by the further steps of after the dumping of the hopper returning the hopper through its thusly described path of movement to its transport position on the sweeper while moving the conveyor into the clearance space at least partially over the linkage pivot.

18. The sweeper of claim 1 further characterized by being provided with means for supporting the sweeper against tipping when said hopper is moved into its dumping position above and forward of the cab.

19. The sweeper of claim 18 further characterized by said sweeper having front and rear axles supporting the frame, said means comprising a counterweight provided at a rear end of said sweeper, said counterweight providing means for maintaining the center of gravity of the sweeper rearward of the front axle.

20. The sweeper of claim 18 further characterized by said means comprising a pair of outriggers positioned beneath a forward end of the sweeper and beneath the hopper for supporting the forward end of the sweeper when the hopper is in its dumping position.

* * * * *